US009782667B1

(12) United States Patent
Carter

(10) Patent No.: US 9,782,667 B1
(45) Date of Patent: Oct. 10, 2017

(54) SYSTEM AND METHOD OF ASSIGNING A TARGET PROFILE FOR A SIMULATION SHOOTING SYSTEM

(71) Applicant: George Carter, Dallas, TX (US)

(72) Inventor: George Carter, Dallas, TX (US)

( * ) Notice: Subject to any disclaimer, the term of this patent is extended or adjusted under 35 U.S.C. 154(b) by 0 days.

(21) Appl. No.: 15/361,287

(22) Filed: Nov. 25, 2016

Related U.S. Application Data

(63) Continuation-in-part of application No. 14/498,112, filed on Sep. 26, 2014, now Pat. No. 9,504,907, which is a continuation-in-part of application No. 14/168,951, filed on Jan. 30, 2014, now Pat. No. 8,888,491, which is a continuation-in-part of application No. 13/611,214, filed on Sep. 12, 2012, now Pat. No. 8,678,824, which is a continuation-in-part of application No. 12/608,820, filed on Oct. 29, 2009, now Pat. No. 8,459,997.

(60) Provisional application No. 61/156,154, filed on Feb. 27, 2009.

(51) Int. Cl.
*A63F 9/02* (2006.01)
*F41A 33/00* (2006.01)

(52) U.S. Cl.
CPC ..... *A63F 9/0291* (2013.01); *F41A 33/00* (2013.01)

(58) Field of Classification Search
CPC ..... F41A 33/00; F41A 33/02; F41A 33/04; F41A 33/06; F41G 3/26; A63F 9/0291
See application file for complete search history.

(56) References Cited

U.S. PATENT DOCUMENTS

| | | | |
|---|---|---|---|
| 5,215,462 | A | 6/1993 | Lewis et al. |
| 6,813,593 | B1 | 11/2004 | Berger |
| 6,899,539 | B1 | 5/2005 | Stallman et al. |
| 7,329,127 | B2 | 2/2008 | Kendir et al. |
| 8,794,967 | B2 | 8/2014 | Sargent |
| 2005/0181745 | A1 | 8/2005 | Wood et al. |
| 2007/0061244 | A1* | 3/2007 | Ramer ..... G06F 17/30867 705/37 |
| 2007/0190494 | A1 | 8/2007 | Rosenberg |
| 2007/0190495 | A1 | 8/2007 | Kendir et al. |
| 2007/0243504 | A1 | 10/2007 | Bjorkman et al. |
| 2009/0305197 | A1 | 12/2009 | Lim et al. |
| 2015/0057057 | A1 | 2/2015 | Fischer |

* cited by examiner

*Primary Examiner* — Timothy A Musselman
(74) *Attorney, Agent, or Firm* — Michael Diaz

(57) ABSTRACT

A shooting simulation system. The shooting system includes a shooting simulation device for targeting a target and a computing device having a processor and a memory. The computing device has a processor and a memory. The memory stores a set of instructions and the processor executes the instructions whereby the instructions determine a target profile based on a current perceived parameter of the targeting of the target. The processor then assigns the determined target profile for use in determining a hit or miss of the targeting of the target by the shooting device.

18 Claims, 7 Drawing Sheets

SYSTEM AND METHOD OF ASSIGNING A TARGET PROFILE FOR A SIMULATION SHOOTING SYSTEM

RELATED APPLICATIONS

This application is a continuation-in-part application of co-pending U.S. patent application Ser. No. 14/498,112 entitled "Simulated Shooting System and Method" filed Sep. 26, 2014 under the name of George Carter which is a continuation-in-part of U.S. Pat. No. 8,888,491 entitled "An Optical Recognition System and Method For Simulated Shooting" filed on Jan. 30, 2014 under the name of George Carter which is a continuation-in-part application of U.S. Pat. No. 8,678,824 entitled "Shooting Simulation System and Method Using an Optical Recognition System" filed on Sep. 12, 2012 under the name of George Carter which is a continuation-in-part application of U.S. Pat. No. 8,459,997 entitled "Shooting Simulation System and Method" filed on Oct. 29, 2009 under the name of George Carter which claims the benefit of U.S. Provisional Patent Application Ser. No. 61/156,154 filed Feb. 27, 2009 by George Carter, all of which is hereby incorporated by reference.

BACKGROUND OF THE INVENTION

Field of the Invention

This invention relates to shooting simulation systems and methods. Specifically, and not by way of limitation, the present invention relates to assigning a target hit profile in a shooting simulation system and method.

Description of the Related Art

There are numerous laser tag games utilizing Infrared (IR) emitters and sensors for playing various forms of tag. U.S. patent application Ser. No. 14/498,112 entitled "Simulated Shooting System and Method" provides for a novel system and method utilizing ordinary mobile phones for playing various forms of simulated shooting operations. Additionally, there are other simulation targeting systems which also simulate firing through the use of various weapons on a target. However, existing simulation targeting systems fail to provide a system or method of assigning a target profile based on predetermined parameters, such as range to the target, movement of the target, effective range of the simulated weapon utilized, etc. It would be advantageous to a have system and method for assigning the target profile in a shooting simulation system. It is an object of the present invention to provide such a system and method.

SUMMARY OF THE INVENTION

In one aspect, the present invention is directed to a shooting simulation system. The shooting system includes a shooting simulation device for targeting a target and a computing device having a processor and a memory. The memory stores a set of instructions and the processor executes the instructions whereby the instructions determine a target profile based on a current perceived parameter of the targeting of the target. The processor then assigns the determined target profile for use in determining a hit or miss of the targeting of the target by the shooting device.

In another aspect, the present invention is directed to a method of assigning a target profile in a shooting simulation system. The method includes the steps of storing a set of instructions for determining a target profile based on a perceived parameter of the targeting of the target, shooting a simulated shooting device at a target, and determining a current perceived parameter of the targeting by the shooting device at the target. Next, the stored instructions are executed for determining a specific target profile based on the current perceived parameter. The determined target profile is then assigned for use in determining a hit or miss of the targeting of the target by the shooting device.

In still another aspect of the present invention, the present invention is directed to a shooting simulation system. The shooting system includes a shooting simulation device for targeting a target and a computing device having a processor and a memory. The memory stores a set of instructions and the processor executes the instructions whereby the instructions determine a munitions' size based on a current perceived parameter of the targeting of the target. The processor then assigns the determined munitions' size for use in determining a hit or miss of the targeting of the target by the shooting device.

DESCRIPTION OF THE INVENTION

Figure 1:
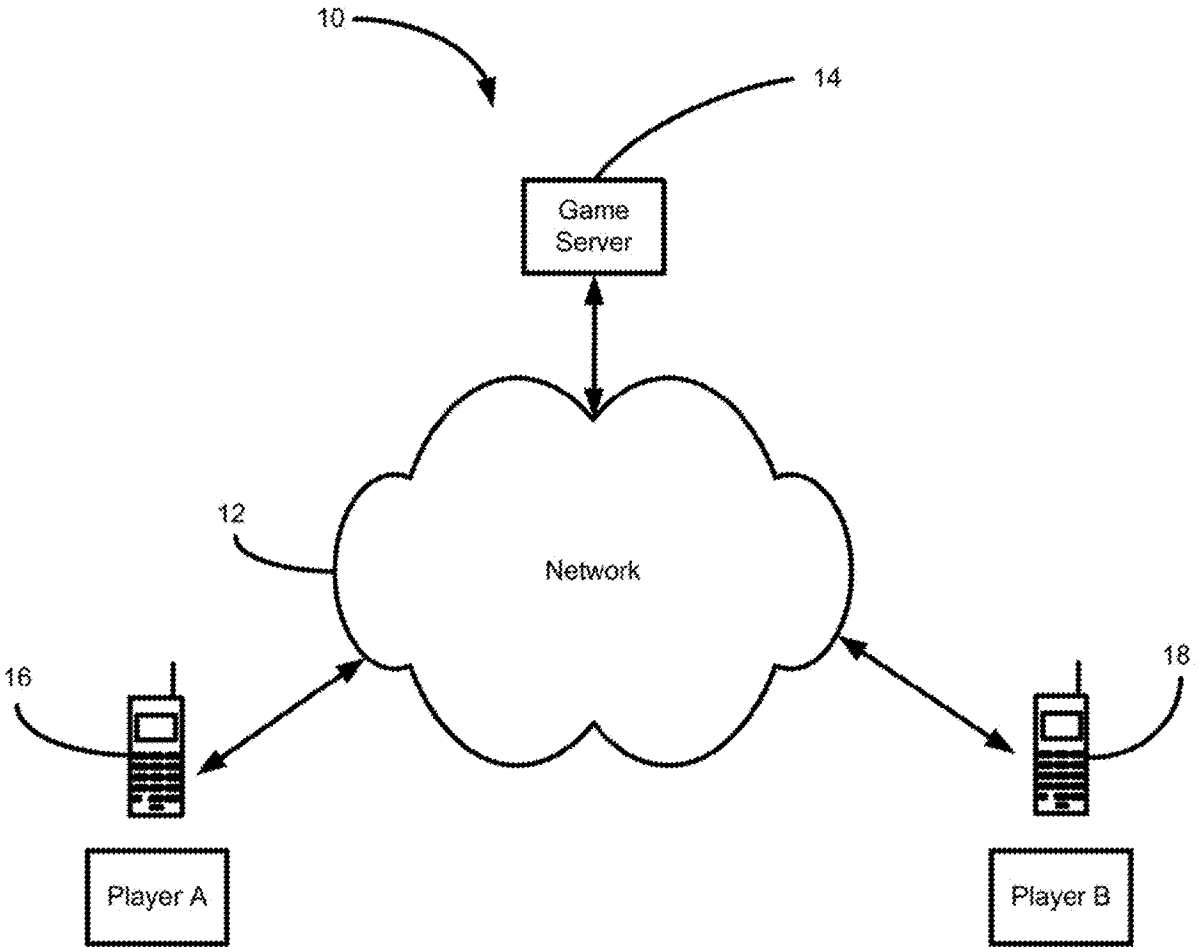
FIG. 1 is a simplified block diagram of a shooting simulation system in one embodiment of the present invention.

In one embodiment, the present invention is a shooting simulation system providing assignment of a target profile based on predetermined parameters. FIG. 1 is a simplified block diagram of a shooting simulation system 10 in one embodiment of the present invention. The system 10 includes a wireless network 12, a game server 14, and a plurality of mobile phones 16 and 18. The wireless network 12 may be any wireless communications network, such as a cellular network, any type of telecommunications network, Wi-Fi, etc. The game server 14 is a computing device communicating with the plurality of mobile phones 16 and 18 via the network 12. The mobile phones 16 and 18 may be any communication device capable of communicating via the wireless network, such as a tablet, phablet, portable computer, etc. It should be understood that the term "mobile phone" shall encompass any of these communication devices. Furthermore, two mobile phones are depicted, however any number of mobile phones may be utilized in the present invention. In addition, each mobile phone may function as a simulated firearm or aiming/targeting device for a simulated airborne weapon system, such as a notional airborne drone. Additionally, each mobile phone is carried by a user. As shown in FIG. 1, the mobile phone 16 is associated with a user A and mobile phone 18 is associated with a user B.

Figure 2:
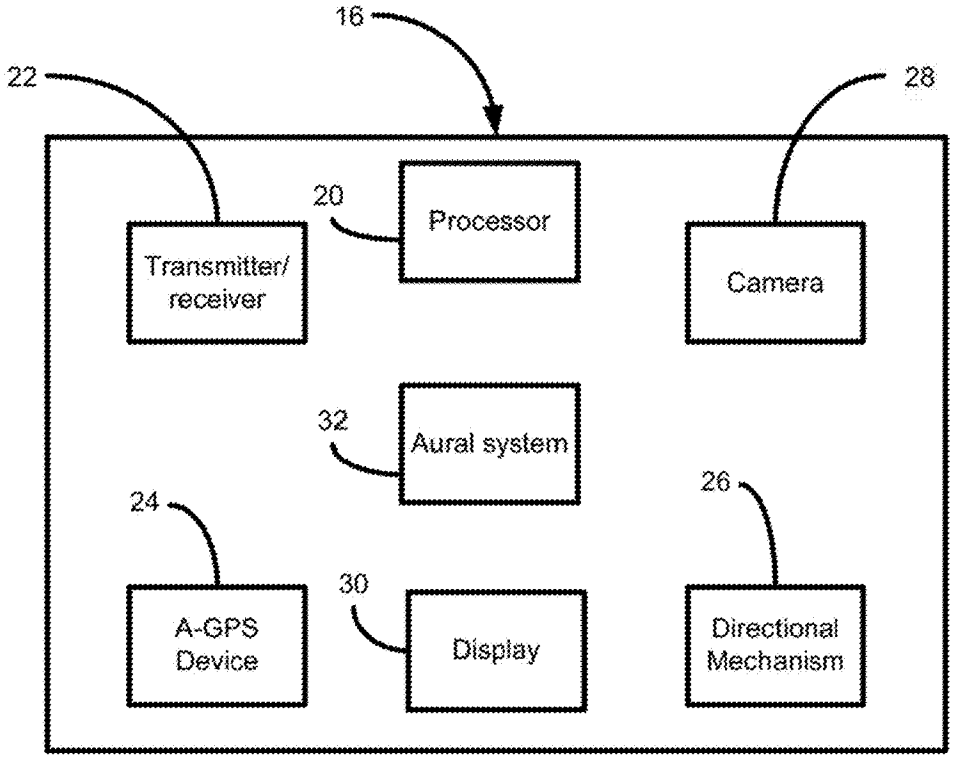
FIG. 2 is a simplified block diagram of the components of a mobile phone used in the system of FIG. 1 in one embodiment of the present invention.

FIG. 2 is a simplified block diagram of the components of a mobile phone in one embodiment of the present invention. The mobile phone 16 includes a processor 20, a transmitter/receiver 22, an Assisted Global Positioning System (A-GPS) device 24, a directional mechanism 26 for determining a directional orientation of an aimed mobile phone, an optional camera 28, and a display 30. The directional mechanism may be incorporated into the A-GPS device or be a separate component utilizing one or more accelerometers and a magnetometer to ascertain a direction of the aimed mobile phone. The processor 20 may be any computing device and incorporate the use of a software application, mobile application (e.g., "app") to accomplish the functions of the present invention. It should be understood that the shooting system 10 described above is merely discussed to illustrate the present invention, however the functionality of assigning a target profile may be implemented in any simulated shooting system.

Although the use of mobile phones are described, any targeting actuation system may be utilized, such as laser, IR beams, geo-pairing, or any device which may be used for acquiring and targeting a target. In addition, the targeting actuation system (e.g., mobile phones) may communicate with other communication devices, such as wearable smart devices, e.g., smart watches, etc. In another embodiment, positional sensors may also reside in other devices worn by the user, such as wearable smart devices, e.g., watches.

In addition, the mobile phone may utilize the display 30 for displaying information to the user, such as hit or miss cues and location of a friendly or opposing user and final game results. In one embodiment, the display may incorporate a touch screen having buttons which may be tapped to actuate a trigger. Furthermore, the mobile phone may also include an aural system 32 having a microphone and a speaker. The aural system may provide an indication of when a hit has been scored against the user, near miss cues (e.g., right/left verbal warnings or displays on a screen associated with the firearm), a realistic noise simulating the firing of a gun, or bullets approaching. The aural system may also provide a verbal call of the accuracy of the shot, such as "miss", "hit", or "miss right/left".

The present invention may be utilized in a game or simulated combat scenario where users A and B are aligned on opposite sides. The present invention may utilize more than two users and include more than two teams. The users utilize their mobile phones 16 and 18 by aiming the mobile phones at an opposing user and actuating a simulated shooting at or targeting of the opposing user. In one embodiment, the user is simulating direct fire, such as shooting a simulated line-of-sight weapon at the opposing user. In another embodiment, the user is aiming and simulating employing indirect fire, such as designating a target for a strike by a notional airborne drone, utilizing mortars, artillery, helicopters, etc. The mobile phone, through the processor, A-GPS device and communication with the game server, knows the location of the opposing user. The mobile phone is "aimed" at the opposing user, specifically the mobile phone is longitudinally aligned (directional or azimuth) with the desired target. Upon actuation of the trigger or triggers or button to tap, the processor may determine the direction of the mobile phone. It may be determined (adjudicated) by the processor of the shooting mobile phone or by the game server having a processor if there would be a hit or miss.

The game server 14 receives location data (e.g., GPS data from each mobile phone) and may independently determine/verify a hit or miss of the target. Since the game server may know the position of each user and the information on the triggered firearm (i.e., the orientation of the mobile phone), the game server may determine/verify a hit or miss. Alternatively, the game server may relay location data of the opposing users mobile phone to the firing user's mobile phone and enable the processor 20 to determine if the fired shot would have been a hit or miss. Additionally, the game server 14 may manage the location of all the users as well as compiling all the hits and misses of each user at a specific location and time during the simulation. This compilation may be used for debrief of the users and determination of the success of each user and each team. The game server may compile a wide variety of data, such as time of firing, accuracy, number of bullets fired, times the user is targeted, etc. In one embodiment, the game server may provide a playback of each encounter providing a graphical representation of each user, trajectory of the simulated bullets, or targeting of the drone. Furthermore, the game server may send back information on a hit or miss to the intended target. For example, the target and its associated mobile phone may be informed that he is killed by receiving an aural warning. A novel functionality of the present invention is the ability of setting or assigning a size or pattern of what is defined as a "hit" or "miss". Additionally, a handicap based on previous performance of the user for the determination of a hit may be utilized to modify the target profile. The target profile may be modified or set by the game server, or in an alternate embodiment, by one of the mobile phones or a separate computing device.

Figure 3:
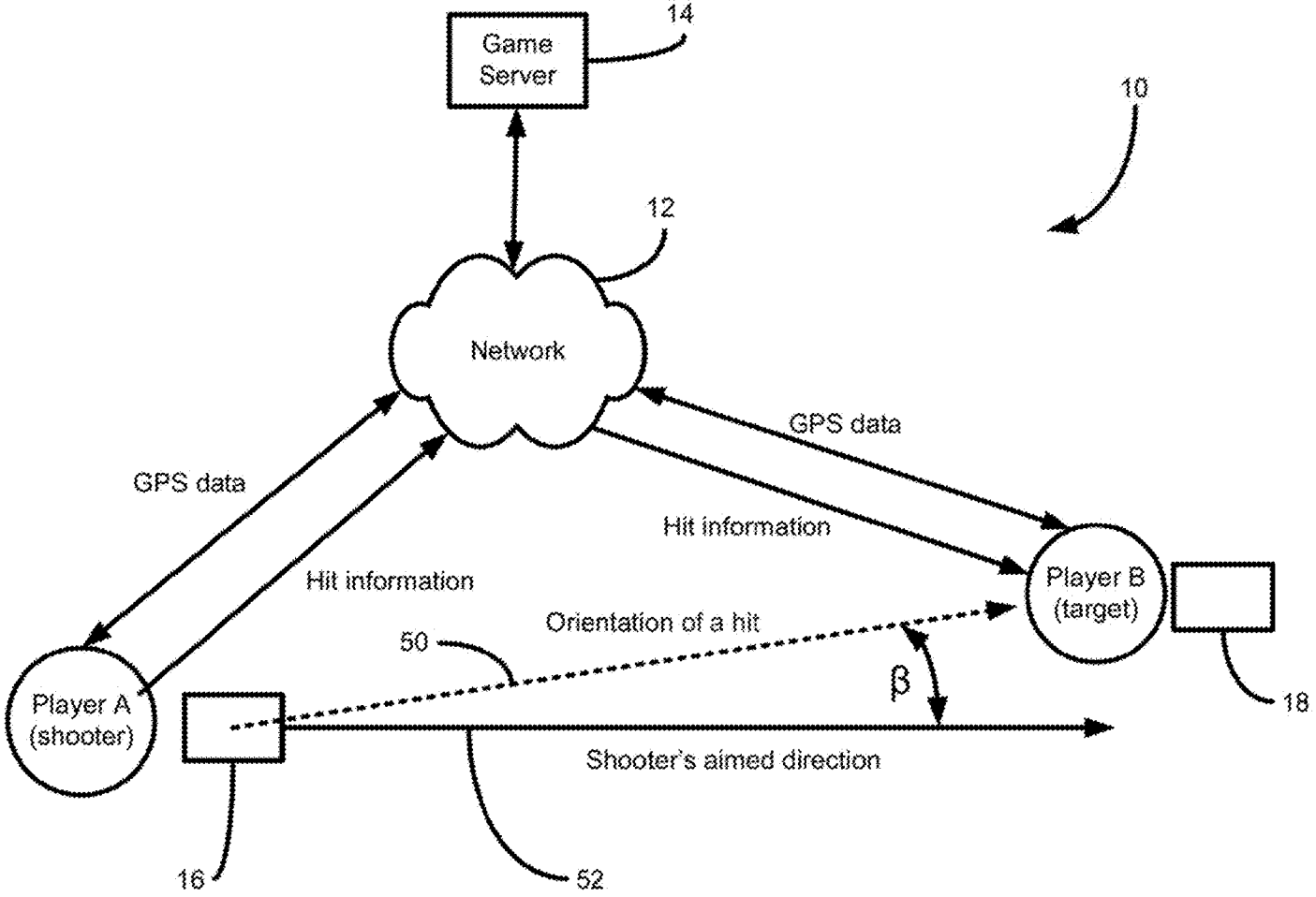
FIG. 3 is a simplified block diagram illustrating the interaction of the components of the system of FIG. 1 for use in the present invention.

FIG. 3 is a simplified block diagram illustrating the interaction of the components for use in the present invention. With reference to FIGS. 1-3, the operation of the system 10 will now be explained. Each user carries a mobile phone 16 or 18. The mobile phone includes a A-GPS device 24 to determine the geographical location of the mobile phone. In one embodiment, the geographical information or GPS data is used to identify the user. In one embodiment, each user's mobile phone receives the GPS data of the opposing user or users' mobile phones. A user, for example user A as shown in FIG. 3, aims the mobile phone 16 at a target, in this example, user B. The directional mechanism 26, which may be incorporated into the A-GPS device, ascertains an aimed direction or azimuth 52 for which the mobile phone is aimed. The processor 20, by knowing the location of mobile phone 16 (user A) and mobile phone 18 (user B), can determine a calculated orientation of a hit 50 between the two mobile phones (or mobile phone and target). The game server 14, the shooting mobile phone (e.g., mobile phone 16), or other computing device may provide a hit criteria, such as a maximum β angular error for which a shot would be scored as a hit. The hit criteria may be set in various ways. In one embodiment, the radius of the "kill zone" may be increased or decreased as desired. Alternatively, rather than assigning a target profile for determining a hit or miss, the present system may increase or decrease the size of the munitions (e.g., bullet). In such an embodiment, for example, the size of the munitions may be increased to increase the ease or probability of a hit. Likewise, the munitions may be decreased in simulated size to decrease the ease or probability of a hit. In various embodiments, the target profile may be assigned in combination or without changing or assigning the munitions' size or the system may change or assign the munitions' size without assigning a target profile. Also, in one embodiment, rather than simulating a shooting firearm, the present invention may simulate targeting a user with a simulated airborne drone. In either case, a hit is determined by the directional accuracy. In another embodiment, the location of both mobile phones at the time of trigger actuation is sent to the game server which adjudicates whether the shot fired or targeting is a hit or miss. The information of a hit (and optionally a miss) may be relayed to either the shooting user or both the shooting and targeted users' mobile phones. In still another embodiment, the system may provide feedback to the targeted player or shooting player of a "near" miss. In such a scenario, the targeted player may receive a warning of a near miss, for example the whizzing of a closely passing bullet. Thus, not only would the target profile be assigned for a hit or miss, in one embodiment, a "near miss" target profile in proximity to the target may be assigned for determining the near miss.

Figure 4:
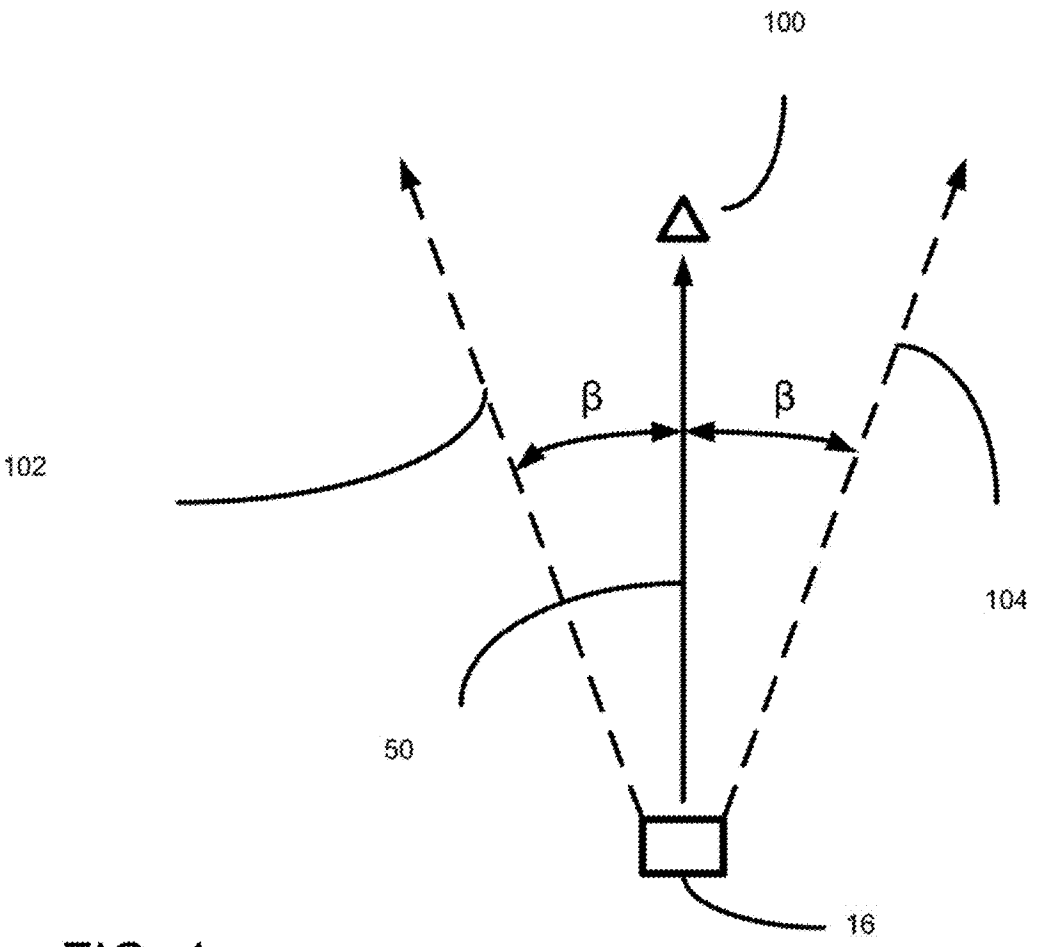
FIG. 4 (Prior Art)
FIG. 4 (prior art) illustrates a simplified block diagram of a constant target profile utilized in existing targeting systems.

To further illustrate the novel functionality of the present invention, FIG. 4 illustrates a simplified block diagram of a constant target profile utilized in existing targeting systems. A shooting mobile phone 16 includes the shooter's calculated orientation 50 aiming at a target 100. In existing system, the maximum β angular error is located on either side of the calculated orientation 50 out to a left boundary 102 and a right boundary 104. If the target is located within the left and right boundaries, a hit is scored. However, in this existing system, the angular error remains the same out to infinity, therefore the ease of scoring a hit on a target does not change for targets located at a further distance since the angular error remains the same out to infinity. Obviously, this scoring methodology is not realistic.

Figure 5:
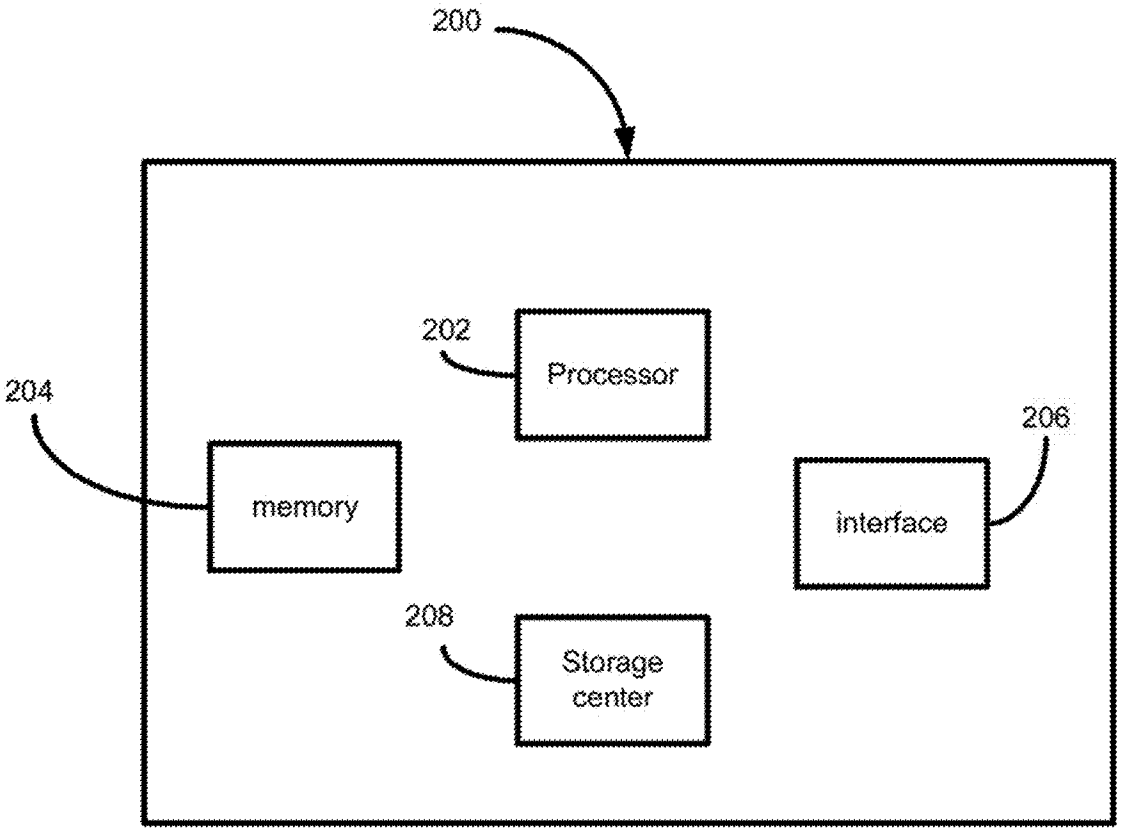
FIG. 5 illustrates the components of a computing device utilized in assigning a target profile or hit criteria.

In the present invention, a target profile of the target may be assigned or set based on a wide range of parameters. Any computing device may be utilized to perform the function of changing a target profile or the simulated munitions utilized in the present invention. The computing device may be the game server 14 or any other computing device, such as located in the mobile phone or in another independent component of the system 10. FIG. 5 illustrates the components of a computing device 200 utilized in assigning a target profile or a munitions hit criteria. The computing device 200 includes a processor 202, a memory 204, an interface 206 connected to the memory 204, and a storage center 208. The processor processes instructions for execution within the computing device 200 as well as instructions stored in the memory 204 or the storage center 208. In other embodiments, multiple processors or multiple busses may be utilized as necessary. Furthermore, multiple computing devices 200 may be connected where each computing device provides portions of the necessary operations of the present invention, such as a multi-processor system a server bank, etc.

The memory 204 stores data or information within the computing device 200. In one embodiment, the memory 204 may be a volatile memory unit. In another embodiment, the memory 204 is a non-volatile memory unit. In addition, the memory 204 may also be any form of a computer-readable medium, such as an optical disk or a magnetic disk.

The storage center 208 may provide mass storage for the computing device 200. In one embodiment, the storage center 208 may include a computer-readable medium, such as a floppy disk device, a hard disk device, an optical disk device, or a tape device, a flash memory or other similar solid state memory device, or an array of devices, including devices in a storage area network or other configurations. In addition, a computer program may be tangibly located instructions which, when executed, perform one or more operations necessary for the present invention. The computer program may be stored in a non-transitory computer or a machine-readable storage medium, such as the memory 204, or the storage center 208

The computing device 200, utilized for performing the operations of the present invention, may be embodied in many different forms. For example, the computing device may be the game server 14 or the processor 20 of the mobile phone 16 or as a group of servers or processors.

Figure 6:
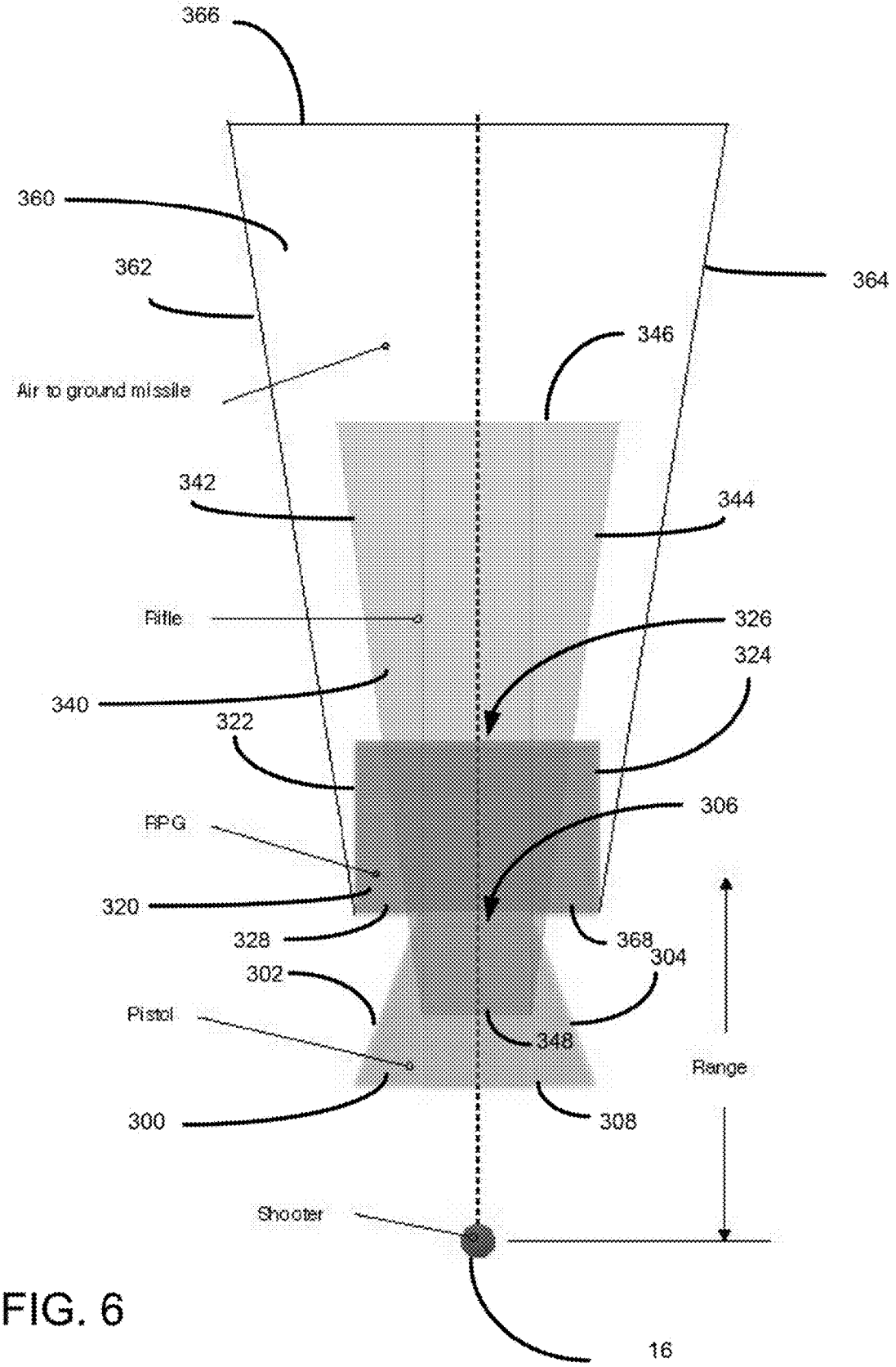
FIG. 6 is a block diagram illustrating different target profiles based on the type of munitions and range to target utilized.

FIG. 6 is a block diagram illustrating different target profiles based on the type of munitions and range to target utilized. As depicted in FIG. 6, various munitions may be simulated by the shooting mobile phone 16. The shooter may use a pistol having a pistol hit criteria 300 defined by a left boundary 302, a right boundary 304, a far boundary 306 and a near boundary 308. Additionally, a rocket propelled grenade (RPG) may have a RPG hit criteria 320 comprising a left boundary 322, a right boundary 324, a far boundary 326 and a near boundary 328. The shooter may also utilize a rifle having a rifle hit criteria 340 with a left boundary 342, a right boundary 344, a far boundary 346, and a near boundary 348. In still another example of a different weapon simulated in the system 10, an air to ground missile may have an air to ground missile hit criteria 360 with a left boundary 362, a right boundary 364, a far boundary 366, and a near boundary 368. As can be seen, the shape and size of the hit criteria may be varied dependent on the type of weapon and range to target utilized. In the example of the pistol, as the range increases, the hit criteria funnels down to a smaller area, replicating a real pistol which would have reduced accuracy for a target located further from the shooter.

FIG. 6 exemplifies how the target profile changes for different types of weapons. Additionally, the targeting profile may be modified dependent on if the target is moving or even as a handicap of a shooter. The computing device 200 utilizes a computer program to perform operations necessary to change and assign the target profile. This may be accomplished when determining the hit criteria by enlarging or reducing the size of the target or increasing the size of the simulated munitions' area of destruction (e.g., a larger bullet to provide a larger target profile). In addition, a predetermined range or effective range may be assigned for the target profile. For example, in accordance with the effective range of the simulated weapon, a new target profile may be assigned to emulate that the target could not be successfully hit beyond a specified distance or provide a lower probability of a hit beyond that predetermined distance. This may be utilized to provide a limited range to the simulated weapons.

With reference to FIGS. 1-6, the operation of the present invention will now be explained. Each user carries a mobile phone, such as mobile phones 16 and 18. Through the mobile mobile's A-GPS device, each mobile phone continually determines its geographical location and relays this information to the game server. The game server 14 sends the opposing user's location information to the other user (e.g., user B's geographical location is sent to user A's mobile phone). The opposing user's geographical information may optionally be displayed to the user for providing situational awareness of a general directional orientation of the user. The computing device 200, which may be located in the game server, in a mobile phone or separately from the other components of the system 10, determines a target profile of the targeted user. In one embodiment, the computing device continuously updates the target profile based on predetermined parameters and boundaries for the selected munitions, range from shooter to target, movement of the target, and/or handicap of the shooting user A. Specifically, the memory in the computing device may store a set of instructions while the processor executes the instructions for determining an appropriate target profile based on the predetermined parameters. The instructions may be a formula or algorithm for determining the appropriate target profile and, in turn assigning the determined target profile. In one embodiment, the computing device 200 may change the size of the target or the munitions used (e.g., the bullet) to modify the hit criteria (i.e., target profile) of the target. User A may then aim the mobile phone 16 at user B and actuates the simulated firing of a weapon. Subsequently, the shot or targeting is adjudicated using the calculated target profile determined by the computing device 200. In one embodiment, the processor in the shooting users mobile phone 16 adjudicates if the shot or targeting was a hit or miss. In another embodiment, the game server receives the aimed direction 50 and true orientation 52 and determines if the shot or targeting was a hit or miss. The mobile phone 16 may inform the game server of the shot or targeting and optionally the results (i.e., hit or miss) for tally by the game server. The hit or miss information may then be relayed to the targeted user's mobile phone 18. The game server 14 may then manage the location of all the users as well as compiling all the hits and misses of each user at a specific location and time during the simulation. This compilation may be used for debrief of the users and determination of the success of each user and each team. The game server may compile such data as time of firing, accuracy, number of bullets fired, times the user is targeted, etc.

Figure 7:
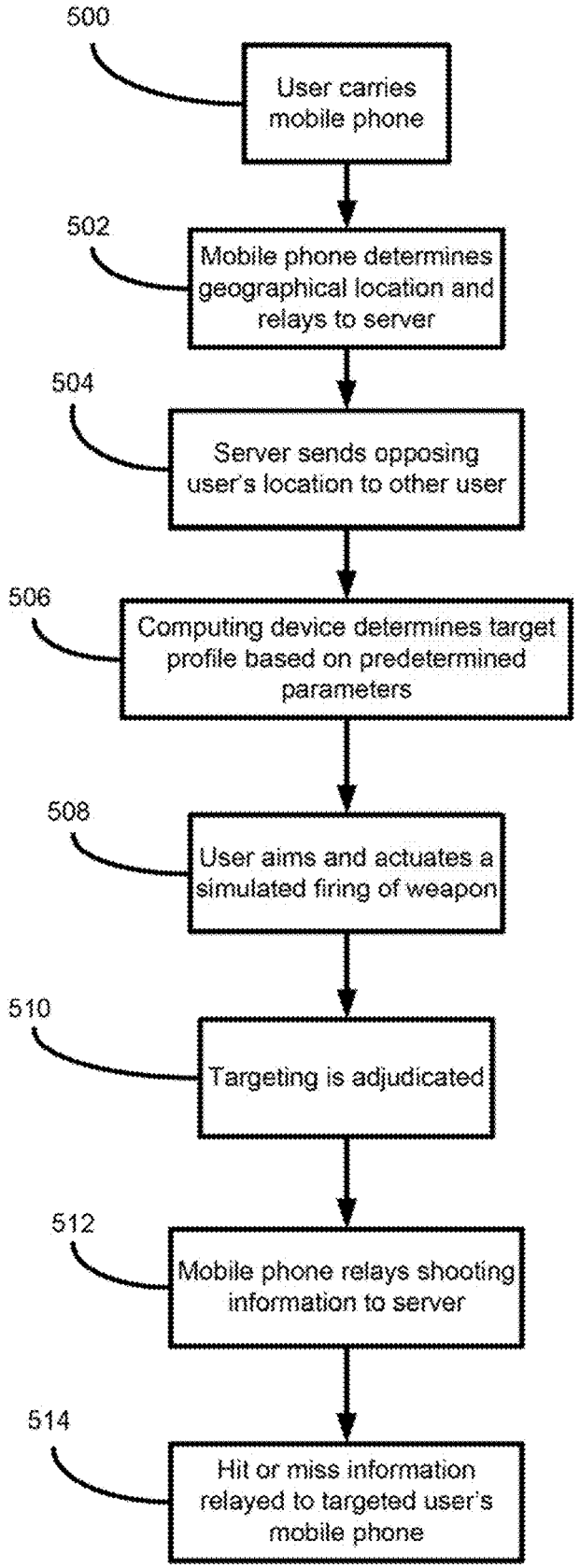
FIG. 7 is a flowchart illustrating the steps of utilizing the system according to the teachings of the present invention.

FIG. 7 is a flowchart illustrating the steps of utilizing the system 10 according to the teachings of the present invention. With reference to FIGS. 1-7, the method will now be explained. In step 500, each user carries a mobile phone, such as mobile phone 16 and 18. Next, in step 502, each mobile phone continually determines its geographical location through the mobile phone's A-GPS device and relays this information to the game server. In step 504, the game server 14 sends the opposing users location information to the other user (e.g., user B's geographical location is sent to user A's mobile phone). The opposing user's geographical information may optionally be displayed to the user for providing situational awareness of a general directional orientation of the user. Next, in step 506, the computing device 200 determines a target profile of the targeted user. In one embodiment, the computing device continuously updates the target profile based on predetermined parameters and boundaries for the selected munitions, range from shooter to target, movement of the target, and/or handicap of the shooting user A. Specifically, the memory in the computing device may store a set of instructions while the processor executes the instructions for determining an appropriate target profile based on the predetermined parameters. The instructions may be a formula or algorithm for determining the appropriate target profile and, in turn assigning the determined target profile. In one embodiment, the computing device 200 may change the size of the target or the munitions used (e.g., the bullet) to modify the hit criteria (i.e., target profile) of the target. In step 508, the user A then aims the mobile phone 16 at user B and actuates the simulated firing of a weapon. Next, in step 510, the shot or targeting is adjudicated using the calculated target profile determined by the computing device 200. In one embodiment, the processor in the shooting user's mobile phone 16 adjudicates if the shot or targeting was a hit or miss. In another embodiment, the game server receives the orientation of a hit 50 and true orientation 52 and determines if the shot or targeting was a hit or miss. In step 512, the mobile phone 16 may inform the game server of the shot or targeting and optionally the results (i.e., hit or miss) for tally by the game server. In step 514, the hit or miss information may then be relayed to the targeted user's mobile phone 18. The game server 14 may then manage the location of all the users as well as compiling all the hits and misses of each user at a specific location and time during the simulation. This compilation may be used for debrief of the users and determination of the success of each user and each team. The game server may compile such data as time of firing, accuracy, number of bullets fired, times the user is targeted, etc.

The present invention provides many advantages over existing shooting simulation systems. The present invention is able to change or assign a target profile based on predetermined parameters, such as range to target, movement of the target, type of weapon utilized, etc. Through the modification of the target profile (i.e., hit criteria), a more realistic or entertaining shooting simulation system is provided to the users.

The present invention may be utilized between two users or multiple users on two or more teams. The present invention may be used as a shooting simulation system and method by a simulated shooting firearm or by a device for targeting a user with a notional airborne drone, missile or other flying object (e.g., beyond visual range). In another embodiment of the present invention, the user may use "blind firing" (e.g., a simulated missile) in a direction to search for a target. Also known as "reconnaissance by blind firing" a game may be played where a user points in a general vicinity of another player. A hit or miss scoring can be assessed based on a target profile or munitions size. In addition, the present invention may be used as a live action, real world military simulation system.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A shooting simulation system, the system comprising:

a shooting simulation device for targeting a target; and a computing device having a processor and a memory, the memory storing a set of instructions and the processor executing the instructions, the instructions determining a target profile based on a current perceived parameter of the targeting of the target;

wherein the target profile is modified by changing a size of the target for determining a hit;

wherein the processor assigns the determined target profile for use in determining a hit or miss of the targeting of the target by the shooting device.

2. The shooting simulation system according to claim 1 wherein the processor implements an analysis to determine a hit or miss of the targeting of the target by the shooting simulation device based on the determined target profile.

3. The shooting simulation system according to claim 1 wherein each target profile includes a hit criteria of a hit or miss of the target.

4. The shooting simulation system according to claim 1 wherein a predetermined parameter is range from the shooting simulation device to the target.

5. The shooting simulation system according to claim 4 wherein a second predetermined parameter is type of simulated weapon utilized by the shooting simulation device.

6. The shooting simulation system according to claim 1 wherein the parameter is a type of simulated weapon utilized by the shooting simulation device.

7. The shooting simulation system according to claim 1 wherein the parameter is a rate of movement of the target.

8. The shooting simulation system according to claim 1 wherein the target profile is modified by changing a size of an area of destruction caused by a specified weapon.

9. The shooting simulation system according to claim 1 wherein the shooting simulation device utilizes an Assisted Global Positioning System (A-GPS) device and a directional mechanism to determine a location and orientation of the shooting simulated device.

10. A method of modifying a target profile in a shooting simulation system, the method comprising the steps of:

storing a set of instructions for determining a target profile based on a perceived parameter of the targeting of the target;

shooting a simulated shooting device at a target;

determining a current perceived parameter of the targeting by the shooting device at the target;

executing the stored set of instructions for determining a specific target profile based on the current perceived parameter; and assigning the determined target profile for use in determining a hit or miss of the targeting of the target by the shooting device, wherein the target profile is modified by changing a size of the target for determining a hit.

11. The method according to claim 10 further comprising the step of implementing an analysis to determine a hit or miss of the targeting of the target by the shooting simulation device based on the determined target profile.

12. The method according to claim 10 wherein each target profile includes a hit criteria of a hit or miss of the target.

13. The method according to claim 10 wherein a predetermined parameter is range from the shooting simulation device to the target.

14. The method according to claim 13 wherein a second predetermined parameter is type of simulated weapon utilized by the shooting simulation device.

15. The method according to claim 10 wherein the parameter is a type of simulated weapon utilized by the shooting simulation device.

16. The method according to claim 10 wherein the parameter is a rate of movement of the target.

17. The shooting simulation system according to claim 10 wherein the simulated shooting device utilizes a Assisted Global Positioning System (A-GPS) device and a directional mechanism to determine a location and orientation of the shooting simulated device.

18. A shooting simulation system, the system comprising:

a plurality of communication devices, each communication device associated with a separate player, wherein each communication device includes an Assisted Global Positioning System (A-GPS) device for determining a location indicia of the communication device and a mechanism for communicating the location indicia to a network, the location indicia providing a location of the communication device;

a game server communicating with the network for relaying the location indicia of each communication device to the plurality of communication devices;

wherein each communication device includes a mechanism for determining a directional orientation of the communication device when aimed;

wherein a shooting communication device targeting a targeted player having a targeted communication device receives location indicia of the targeted communication device; and a shooting processor within the shooting communication device for determining if a simulated targeting of another player is a hit or miss based on the location indicia of the shooting communication device, the location indicia of the targeted communication device of the targeted player received from the game server, and the directional orientation of the shooting communication device;

the shooting processor within the shooting communication device determining a hit or miss of the targeting of another player and providing immediate feedback of a hit or miss to a shooting player of the shooting communication device;

wherein the shooting processor determines a target profile based on a current perceived parameter of the targeting of the target;

wherein the shooting processor assigns the determined target profile for use in determining a hit or miss of the targeting of the target by the shooting device.

* * * * *